US007421870B1

(12) United States Patent
Wu et al.

(10) Patent No.: US 7,421,870 B1
(45) Date of Patent: Sep. 9, 2008

(54) LOCK CORE ASSEMBLY

(76) Inventors: Hsiu-Chuan Wu, No. 6-2, Houbi Rd., Kanding Hsiang, Pingtung Hsien (TW); I-Chien Hsin, 19F, No. 243, Sec. 2, Minsheng Rd., Banciao City (TW)

( * ) Notice: Subject to any disclaimer, the term of this patent is extended or adjusted under 35 U.S.C. 154(b) by 0 days.

(21) Appl. No.: 11/873,320

(22) Filed: Oct. 16, 2007

(51) Int. Cl.
*E05B 27/04* (2006.01)

(52) U.S. Cl. ..... 70/358; 70/378; 70/419; 70/493

(58) Field of Classification Search ..... 70/419, 70/409, 358, 359, 421, 378, 392, 491, 493–496, 70/DIG. 22, DIG. 29, DIG. 2, DIG. 5, DIG. 15, 70/DIG. 76, DIG. 23, DIG. 37, DIG. 54, 70/DIG. 74
See application file for complete search history.

(56) References Cited

U.S. PATENT DOCUMENTS 2,192,371 A * 3/1940 Brantingson ..... 70/493
2,653,467 A * 9/1953 Segal ..... 70/359
3,494,158 A * 2/1970 Bauer et al. ..... 70/493
4,325,241 A * 4/1982 Keller ..... 70/358
6,675,617 B2 * 1/2004 Stemmerik ..... 70/493
7,272,965 B2 * 9/2007 Dolev ..... 70/276
2006/0048554 A1 * 3/2006 Keller ..... 70/493

* cited by examiner

*Primary Examiner*—Lloyd A Gall
(74) *Attorney, Agent, or Firm*—Hershkovitz & Associates, LLC; Abe Hershovitz

(57) ABSTRACT

A lock core assembly has a lock shell, a lock core and a pin segment. The lock shell has a core mount, multiple upper pin chambers and a lid. The lock core is mounted rotatably in the core mount and has a keyhole and multiple lower pin chambers. The lower pin chambers are formed radially through an outer surface of the lock core, communicate with the keyhole, align longitudinally, correspond to and communicate with the upper pin chambers. The pin segment is mounted between the lock shell and the lock core and has multiple pin assemblies and at least one suspended pin assembly. When knocked, a suspended upper pin of the at least one suspended pin assembly oscillates to prevent the pin aligning and the lock core from rotating, the lock core assembly provides a preferred burglarproofing effect.

2 Claims, 3 Drawing Sheets

LOCK CORE ASSEMBLY

BACKGROUND OF THE INVENTION

1. Field of the Invention

The present invention relates to a lock core assembly, and more particularly to a lock core assembly that has a suspended structure to provide a preferred burglarproofing effect.

2. Description of Related Art

A conventional lock core assembly has a lock shell, a lock core and multiple pin assemblies. The lock core is mounted rotatably in the lock shell and has a keyhole and an interface. The interface is defined between the lock core and lock shell. The pin assemblies are respectively mounted through the lock shell and in the lock core and each pin assembly has a lower pin, an upper pin and a spring. The lower pins are mounted slidably in the lock core and have various lengths and a top. The upper pins have a bottom, are mounted slidably in the lock shell and the bottoms of the upper pins abut the tops of the lower pins. The springs are mounted between the upper pins and the lock shell to press the upper pins against the lower pins.

Therefore, the upper pin of each pin assembly is disposed at the interface between the lock core and lock shell. To open the lock, a key having multiple corresponding ridges of various lengths is inserted into the keyhole. The multiple ridges correspond in length to the lower pin assemblies and push the lower pin assemblies against the springs causing the bottoms of the upper pins and tops of the lower pins to align with the interface between the lock shell and lock core and allow the lock core to rotate relative to the lock shell.

However, a burglar may try to use a lock pick to vibrate or knock the lock core assembly thereby forming a gap between the upper and lower pins of the pill assemblies. When the gap between the upper and lower pins of the pin assemblies are aligned with the interface between the lock shell and the lock core, the burglar can turn the lock core relative to the lock shell to unlock the lock core assembly. Therefore, the conventional lock core assembly requires improved burglarproofing.

To overcome the shortcomings, the present invention provides a lock core assembly with a suspended structure to mitigate or obviate the aforementioned problems.

SUMMARY OF THE INVENTION

The primary objective of the present invention is to provide a lock core assembly that has a suspended structure to provide a preferred burglarproofing effect.

The lock core assembly in accordance with the present invention has a lock shell, a lock core and a pin segment. The lock shell has a core mount, multiple upper pin chambers and a lid. The lock core is mounted rotatably in the core mount and has a keyhole and multiple lower pin chambers. The lower pin chambers are formed radially through an outer surface of the lock core, communicate with the keyhole, align longitudinally, correspond to and communicate with the upper pin chambers. The pin segment is mounted between the lock shell and the lock core and has multiple pin assemblies and at least one suspended pin assembly. When knocked, a suspended upper pin of the at least one suspended pin assembly oscillates to prevent the pin aligning with, and the lock core from rotating, the lock core assembly provides a preferred burglarproofing effect.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
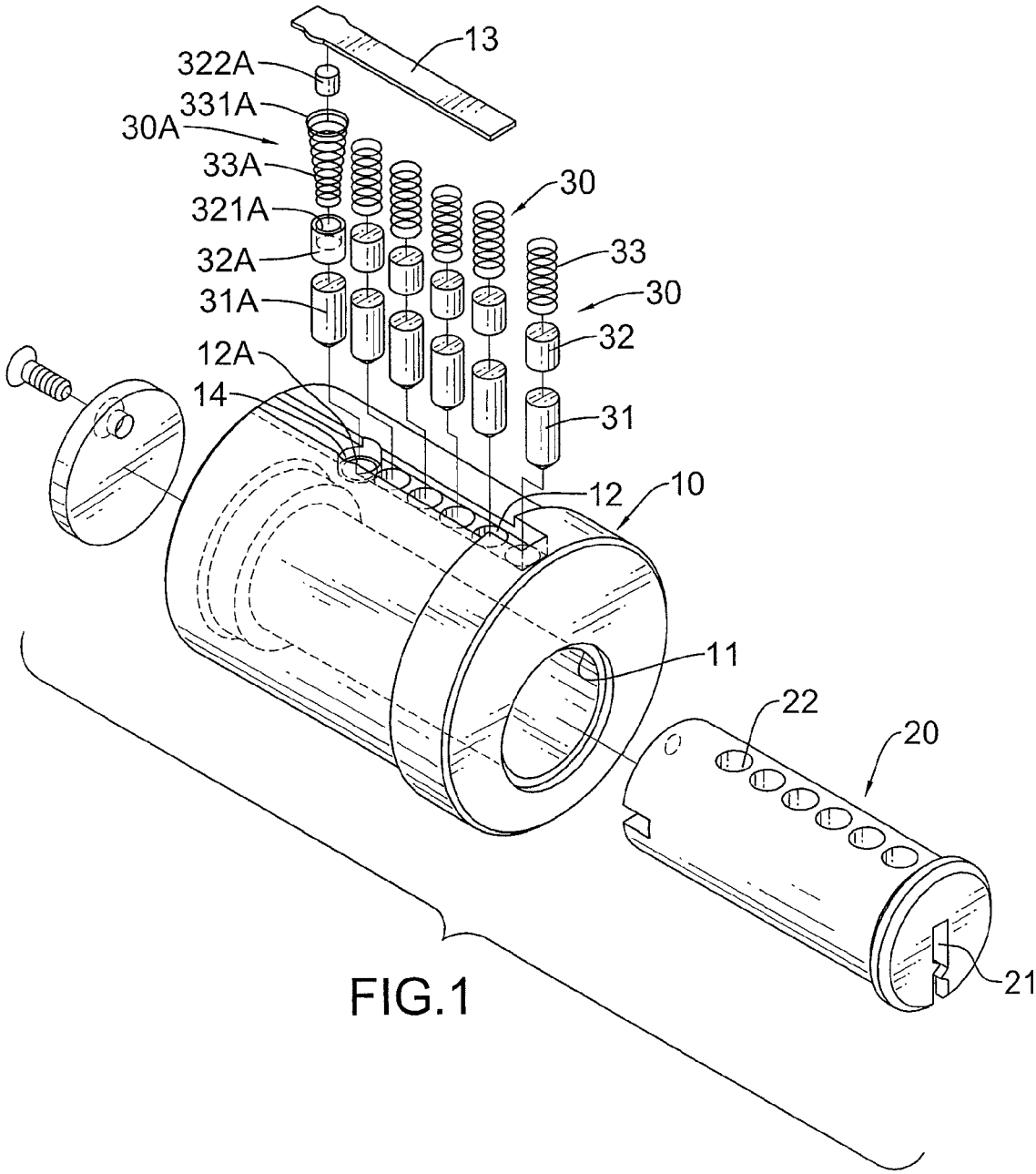
FIG. 1 is an exploded perspective view of a lock core assembly in accordance with the present invention.
Figure 2:
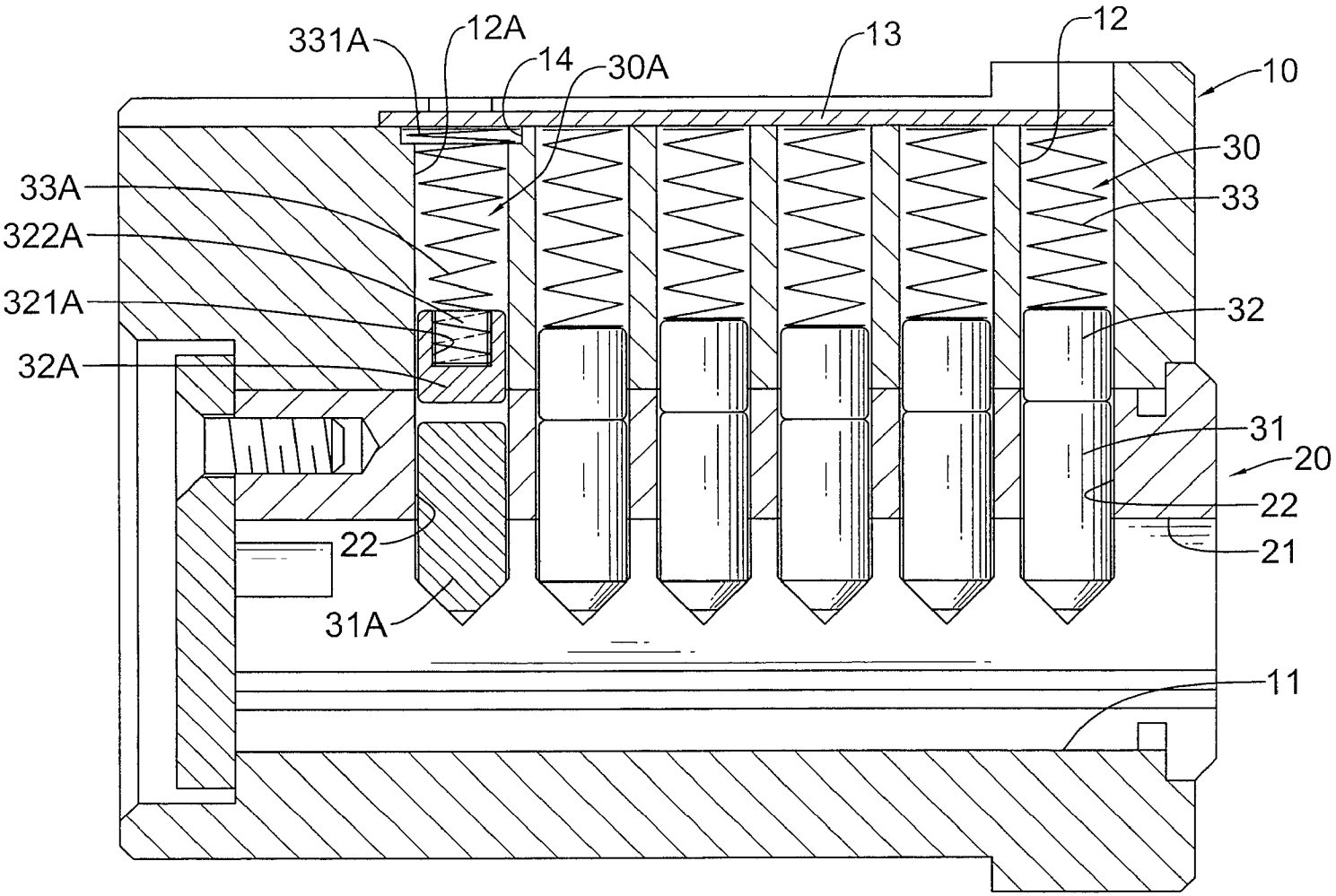
FIG. 2 is a side view in partial section of the lock core assembly in FIG. 1.

With reference to FIGS. 1 and 2, a lock core assembly in accordance with the present invention has a lock shell (10), a lock core (20) and a pin segment.

The lock shell (10) has an outer surface, a core mount (11), multiple upper pin chambers (12, 12A), at least one retaining cavity (14) and a lid (13).

The core mount (11) is formed longitudinally through the lock shell (10) and has an inner surface.

The upper pin chambers (12, 12A) are formed radially through the outer surface of the lock shell (10), are aligned longitudinally, communicate with the core mount (11).

The at least one retaining cavity (14) is formed in the outer surface of the lock shell (10), formed around, communicates with and is larger than at least one of the upper pin chambers (12A).

The lid (13) is mounted detachably on the outer surface of the lock shell (10) and covers the upper pin chambers (12, 12A).

The lock core (20) may be a cylinder, is mounted rotatably in the core mount (11) in the lock shell (10) and has an outer surface, an interface, a keyhole (21) and multiple lower pin chambers (22).

The interface is defined between the outer surface of the lock core (20) and the core mount (11).

The keyhole (21) is formed longitudinally in the lock core (20).

The lower pin chambers (22) are formed radially through the outer surface of the lock core (20), communicate with the keyhole (21), align with, correspond to and communicate with the upper pin chambers (12, 12A).

The pin segment is mounted between the lock shell (10) and the lock core (20) and has a default position, at least one suspended pin assembly (30A) and multiple pin assemblies (30).

Each suspended pin assembly (30A) is mounted in the upper pin chamber (12A) that is communicated with the at least one retaining cavity (14) and the corresponding lower pin chamber (22) and has a lower pin (31A), a suspended upper pin (32A) and a second spring (33A).

The lower pin (31A) is mounted slidably in the lower pin chamber (22) aligned with the upper pin chamber (12A) and the retaining cavity (14) and has a top end.

The suspended upper pin (32A) is mounted slidably in the corresponding upper pin chamber (12A) at an interval over the lower pin (31A) and has an open top end, a closed bottom end, a spring recess (321A) and a mounting rod (322A). The spring recess (321A) is formed in the suspended upper pin (32A) from the open top end to the closed bottom end. The mounting rod (322A) is mounted securely in the spring recess (321A) of the suspended upper pin (32A).

The second spring (33A) is mounted in the at least one retaining cavity (14), is attached to and may be tapered toward the suspended upper pin (32A) and may further be mounted in the spring recess (321A) and held in the spring recess (321A) by the mounting rod (322A) and suspends the upper pin (32A) above the lower pin (31A) of the suspended pin assembly (30A) in the default position.

The pin assemblies (30) are mounted in the other upper and lower pin chambers (12, 22), and each pin assembly (30) has a lower pin (31), an upper pin (32) and a first spring (33).

The lower pins (31) have top ends, various lengths and are mounted slidably in the lower pin chambers (22).

The upper pins (32) are mounted slidably in the upper pin chambers (12), are abutted with the lower pins (31) and each upper pin (32) has a top and a bottom end. The bottom end of the upper pin (32) is abutted with the top end of a corresponding lower pin (31).

The first springs (33) are mounted in the upper pin chambers (12) between the upper pins (32) and the lid (13) and each first spring (33) has a constant diameter and presses the upper pin (32) against the lower pin (31) in the default position.

Since the lower pins (31, 31A) do not have uniform lengths, in the default situation, the upper pins (32, 32A) of the pin assemblies (30, 30A) are disposed at the interface between the lock shell (10) and the lock core (20) and prevent the lock core (20) from rotating relative to the lock shell (10).

Figure 3:
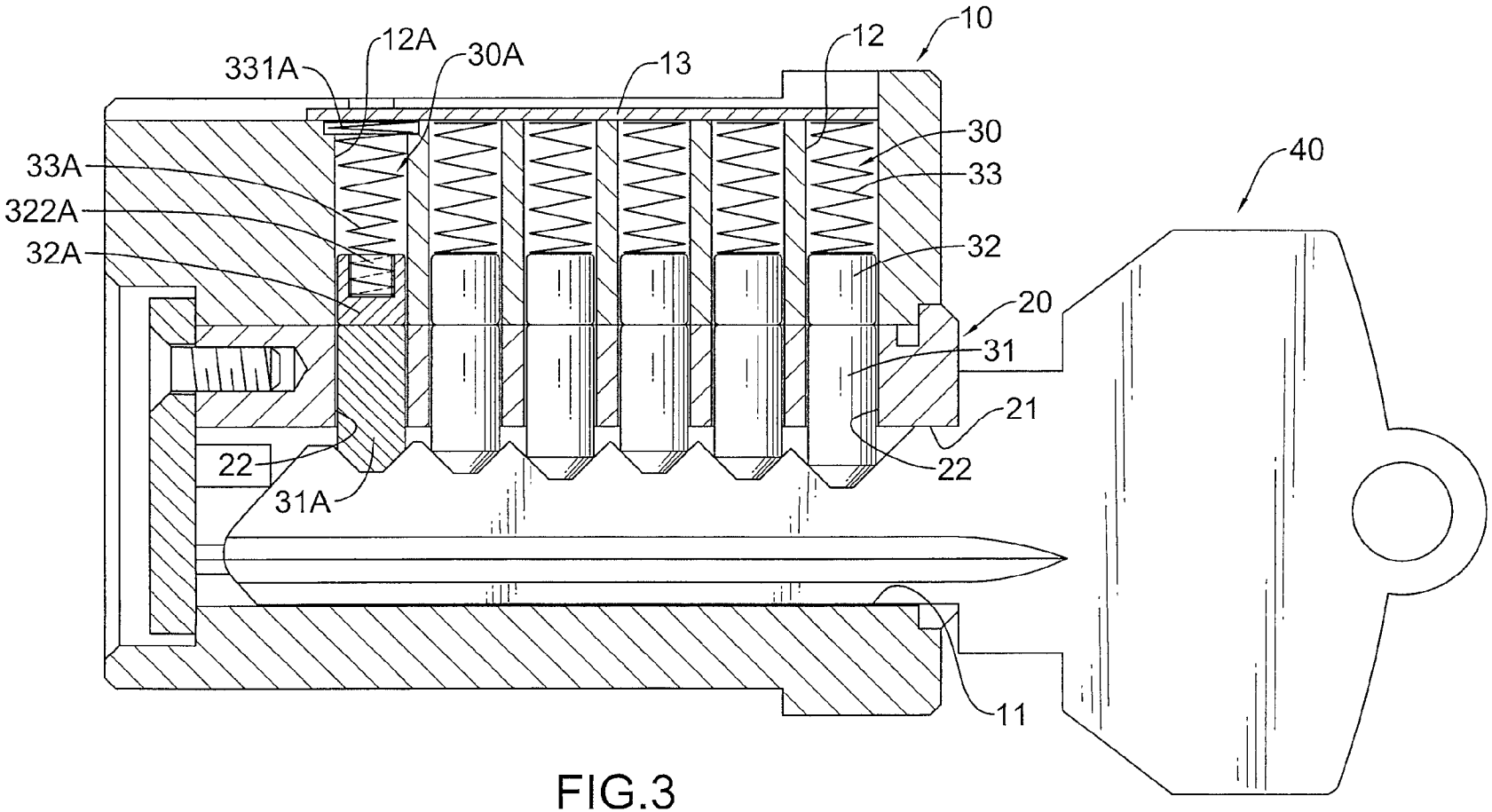
FIG. 3 is an operational side view in partial section of the lock core assembly in FIG. 1, shown with a corresponding key inserted into a lock core of the lock core assembly.

With further reference to FIG. 3, when a corresponding key (40) having multiple ridges is inserted into the keyhole (21) in the lock core (20), the ridges on the key (40) abut and press the pin assemblies (30, 30A) up to align the bottoms of the upper pins (32, 32A) and the tops of the lower pins (31, 31A) with the interface between the core mount (11) and the lock core (20), allowing the lock core (20) to turn relative to the lock shell (10) to unlock the lock core assembly.

However, when a lock pick is used to bounce and align the upper and lower pins (32, 32A, 31, 31A), the suspended upper pin (32A) of the at least one suspended pin assembly (30A) continues to oscillate after each knock and is very difficult to align, especially simultaneously with the upper pins (32) of the pin assemblies (30). Therefore, the lock core assembly in accordance with the present invention can provide a preferred burglarproofing effect.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock core assembly having a lock shell having an outer surface;

a core mount being formed longitudinally through the lock shell and having an inner surface;

multiple upper pin chambers being formed radially through the outer surface of the lock shell, being aligned longitudinally and communicating with the core mount;

at least one retaining cavity being formed in the outer surface of the lock shell, formed around and communicating with at least one of the upper pin chambers; and a lid being mounted detachably on the outer surface of the lock shell and covering the upper pin chambers;

a lock core being mounted rotatably in the core mount in the lock shell and having an outer surface; and an interface being defined between the outer surface of the lock core and the core mount;

a keyhole being formed longitudinally in the lock core; and multiple lower pin chambers being formed radially through the outer surface of the lock core, communicating with the keyhole, aligning with, corresponding to and communicating with the upper pin chambers; and a pin segment being mounted between the lock shell and the lock core and having at least one suspended pin assembly being respectively mounted in at least one of the upper pin chambers communicating with the at least one retaining cavity and at least one corresponding lower pin chamber and each one of the at least one suspended pin assembly having a lower pin being mounted slidably in a corresponding lower pin chamber and having a top end;

a suspended upper pin being mounted slidably in a corresponding upper pin chamber with an interval over the lower pin; and a second spring being attached to the suspended upper pin; and multiple abutting pin assemblies being mounted in the other upper and lower pin chambers away from the at least one retaining cavity and each abutting pin assembly having a lower pin being mounted slidably in one of the lower pin chambers and having a top end;

an upper pin being mounted slidably in a corresponding upper pin chamber and having a top end; and a bottom end being abutted with the top end of the lower pin; and a first spring being mounted in a corresponding upper pin chamber between the upper pin and the lid and pressing the upper pin against the lower pin.

2. The lock core assembly as claimed in claim 1, wherein the suspended upper pin of each one of the at least one suspended pin assembly further has an open top end;

a closed bottom end;

a spring recess being formed in the suspended upper pill from the open top end to the closed bottom end; and a mounting rod being mounted securely in the spring recess; and the second spring of each one of the at least one suspended pin assembly is tapered toward a corresponding suspended upper pin and is mounted in and held in the spring recess in the corresponding suspended upper pin by a corresponding mounting rod and suspends the corresponding suspended upper pin above a corresponding lower pin at the interval.

* * * * *